US005483878A

United States Patent [19]

Hanzawa

[11] Patent Number: 5,483,878

[45] Date of Patent: Jan. 16, 1996

[54] MIMEOGRAPHIC PRINTING MACHINE

[75] Inventor: Hiroshi Hanzawa, Tokyo, Japan

[73] Assignee: Riso Kogaku Corporation, Tokyo, Japan

[21] Appl. No.: 339,180

[22] Filed: Nov. 10, 1994

[30] Foreign Application Priority Data

Nov. 11, 1993 [JP] Japan ..... 5-282707

[51] Int. Cl.[6] ..... B41F 15/22

[52] U.S. Cl. ..... 101/118; 101/419

[58] Field of Search ..... 101/116, 117, 101/118, 119, 120, 129, 419

[56] References Cited

U.S. PATENT DOCUMENTS

| | | | |
|---|---|---|---|
| 2,647,463 | 8/1953 | Ferrar | 101/419 |
| 3,283,710 | 11/1966 | Zahradnik et al. | 101/118 |
| 4,256,037 | 3/1981 | Vertegaal | 101/118 |
| 4,911,069 | 3/1990 | Hayama et al. | 101/120 |
| 5,060,567 | 10/1991 | Hayama et al. | 101/120 |
| 5,081,924 | 1/1992 | Ohinata et al. | 101/120 |
| 5,372,066 | 12/1994 | Proctor | 101/118 |
| 5,375,516 | 12/1994 | Hasegawa | 101/118 |

*Primary Examiner*—Stephen Funk

*Attorney, Agent, or Firm*—Sughrue, Mion, Zinn, Macpeak & Seas

[57] ABSTRACT

A mimeographic printing machine includes a flexible rotary cylindrical printing drum, a lower pusher roller, an inside pusher roller, inside pusher roller controller, and printing sheet conveyor. A stencil paper is wound on the outer surface of the flexible rotary cylindrical printing drum. The lower pusher roller is provided in parallel with the flexible rotary cylindrical printing drum with a predetermined space between the lower pusher roller and the flexible rotary cylindrical printing drum and inside the flexible rotary cylindrical printing drum. The inside pusher roller controller moves the inside pusher roller between a deformation position to push the flexible tubular wall radially outwardly thereby to deform the flexible tubular wall towards the lower pusher roller in the case of printing, and a steady position to release the flexible tubular wall from the deformation in the case of non-printing. The printing sheet conveyor moves the printing sheet from the sheet supplying section through the space.

7 Claims, 8 Drawing Sheets

MIMEOGRAPHIC PRINTING MACHINE

BACKGROUND OF THE INVENTION

1. Field of the Invention

This invention relates to mimeographic printing machines, and more particularly to a mimeographic printing machine having a flexible rotary cylindrical printing drum.

2. Description of the Prior Art

For instance, U.S. Pat. No. 4,911,069 and U.S. Pat. No. 5,081,924 have disclosed a mimeographic printing machine which comprises: a flexible rotary cylindrical printing drum made up of a flexible tubular wall having an ink passing structure on which a stencil paper is wound; a lower pusher roller provided in parallel with the flexible rotary cylindrical printing drum with a predetermined space between the lower pusher roller and the drum; and an inside pusher roller provided inside the cylindrical printing drum in such a manner that it is extended in parallel with one of the generating lines of the cylindrical printing drum, the inside pusher roller being movable between a deformation position to push the tubular wall radially outwardly thereby to deform the latter towards the lower pusher roller, and a steady position to release the flexible tubular wall from the deformation, in which machine, with the inside pusher roller at the deformation position, a printing sheet is supplied from a sheet supplying section to the space between the cylindrical printing drum and the lower pusher roller to perform a pressure type mimeographic printing operation, and the printing sheet, after printed, (hereinafter referred to as "a printed sheet", when applicable) is discharged into a sheet discharging section.

In general, in mimeographic printing machines including the above-described machine, printed sheets are stacked on the sheet discharging tray in the sheet discharging section with the print sides at the top. Hence, when, before the ink on a first printing sheet dries, a second printing sheet is laid on the first printing sheet, then an ink transferring phenomenon may occur: that is, the ink of the first printing sheet may partially transfer onto the back of the second printing sheet. That is, the ink set-off may occur.

In order to prevent the ink set-off, the following method has been employed in the art: That is, a blank sheet, namely, an intermediate sheet is laid on the printed sheet, so that the printed sheets are not directly brought into contact with each other.

In providing a number of printed sheets, sometimes it is necessary to group printed sheets every predetermined number of printed sheets. For this purpose, the following sheet supplying device has been proposed in the art. The device automatically inserts a dividing sheet such as a piece of tape between printed sheets on the sheet discharging tray thereby to suitably divide the printed sheets into groups.

In order to automatically supply the intermediate sheet to the sheet discharging tray, it is necessary to provide a high-speed sheet supplying device which is able to supply the intermediate sheets one at a time in synchronization with the sheet discharging operation and at a high speed corresponding to the printing speed of the printing machine so that the intermediate sheets and the printed sheets are alternately delivered to the sheet discharging tray. However, the device is used only for supplying the intermediate sheets, and is considerably expensive. That is, the use of the device is not economical.

SUMMARY OF THE INVENTION

In view of the foregoing, an object of this invention is to provide a mimeographic printing machine in which supplying the intermediate sheets or the dividing sheets is achieved economically without use of specialized devices, and to achieve the object with a mimeographic printing machine having a flexible rotary cylindrical printing drum.

The foregoing object of the invention has been achieved by the provision of a mimeographic printing machine comprising: a flexible rotary cylindrical printing drum including a flexible tubular wall enabling to pass an ink, on the outer surface of which a stencil paper is wound; a lower pusher roller in parallel with the flexible rotary cylindrical printing drum with a predetermined space between the lower pusher roller and the flexible rotary cylindrical printing drum; an inside pusher roller provided inside the flexible rotary cylindrical printing drum in such a manner that the inside pusher roller is extended in parallel with one of the generating lines of the flexible rotary cylindrical printing drum, the inside pusher roller being movable between a deformation position to push the flexible tubular wall radially outwardly thereby to deform the flexible tubular wall towards the lower pusher roller, and a steady position to release the flexible tubular wall from the deformation; a sheet supplying section for supplying a printing sheet to the lower pusher roller; inside pusher roller controlling means for positioning the inside pusher roller at the steady position in case of non-printing and the deformation position in case of printing in association with the sheet supplying operation of the sheet supplying section; and printing sheet conveying means for moving the printing sheet through the space between the flexible rotary cylindrical printing drum and the lower pusher roller.

In the mimeographic printing machine, the lower pusher roller may have a printing sheet clamping mechanism which is adapted to clamp the front leading end portion of the printing sheet supplied from the sheet supplying section in such a manner that the front leading end portion can be released, and to convey the printing sheet towards the sheet discharging section in association with the rotation of the lower pusher roller, and which the lower pusher roller may serve as the printing sheet conveying means.

In the mimeographic printing machine thus organized, the inside pusher roller is selectively set at the steady position by the inside pusher roller position controlling means in association with the sheet supplying operation of the sheet supplying section. Under the condition that the inside pusher roller is held at the steady position by the inside pusher roller position controlling means, the printing sheet supplied from the sheet supplying section is caused to pass through the space by the printing sheet conveying means in such a manner that it is not brought into contact with the cylindrical drum. The printing sheet thus passed is used as the intermediate sheet or dividing sheet as it is (not being printed).

DETAILED DESCRIPTION OF THE PREFERRED EMBODIMENTS

Figure 1:
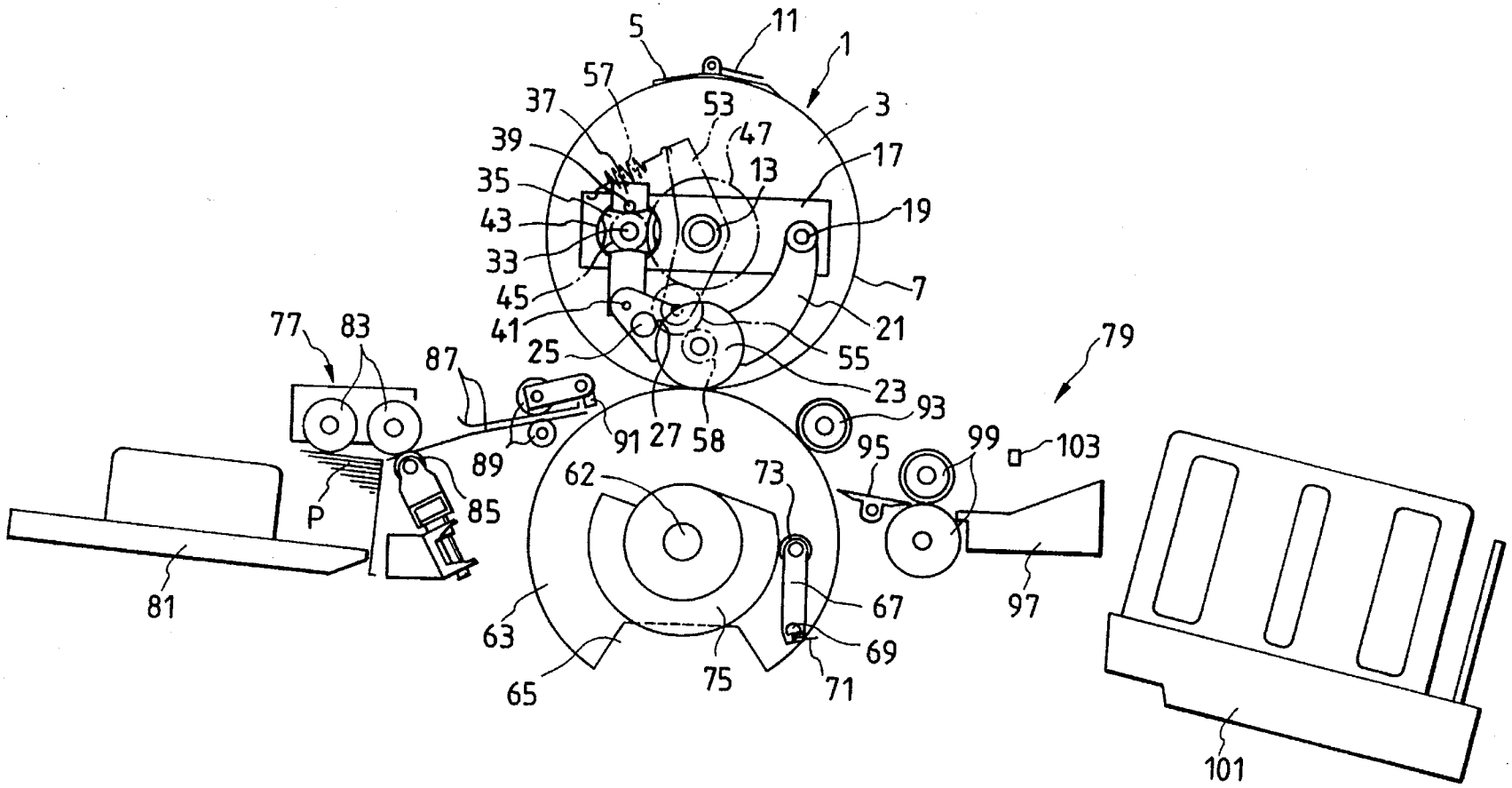
FIG. 1 is an explanatory diagram outlining the arrangement of a mimeographic printing machine according to the invention which is in a printing mode.

Preferred embodiments of this invention will be described with reference to the accompanying drawings.

FIGS. 1 through 4 show an example of a mimeographic printing machine, which constitutes a first embodiment of the invention. In those figures, reference numeral 1 designates a flexible rotary cylindrical printing drum (hereinafter referred to merely as "a drum 1", when applicable). The drum 1 comprises: a pair of disk-shaped rigid side boards 3 at both ends; a rigid clamp base plate 5 which is extended axially (along the generating line of the drum) to connect the pair of side boards 3; and a screen member 9 laid cylindrical to form a flexible tubular wall 7 with the right and left edges supported by the side boards 3. The screen member 9 is a net formed by weaving wires such as stainless wires. Printing ink is allowed to pass through the meshes of the net. The screen member 9 forming the flexible tubular wall 7 is flexible, and therefore the latter 7 is radially deformable.

A clamp plate 11 for detachably clamping an end portion (front leading end portion) of a mimeographic stencil paper is coupled to the clamp base plate 5. A mimeographic stencil paper is set on the drum as follows: With the front leading end portion of the stencil paper locked to the clamp base plate 5 by the clamp plate 11, the stencil paper is wound on the flexible tubular wall 7.

The drum 1 has a central cylindrical shaft 13 which is a fixed shaft extended through the drum on the axis, thus supporting the drum; that is, the drum 1 mounted on the central cylindrical shaft 13 is rotatable around its central axis. Drum driving gears 15 are formed in the outer peripheries of the pair of side boards 3, respectively. The gears 15 mesh with driving gears of a drum driving motor (not shown), so that the drum is rotated counterclockwise (in FIG. 1) around the central cylindrical shaft 13.

Inside the drum 1, an inside frame 17 is fixedly provided being supported by the central cylindrical shaft 13.

The inside frame 17 supports an inside pusher arm 21 at one end through a shaft 19 in such a manner that the inside pusher arm 21 is substantially vertically swingable. The middle portion of the inside pusher arm 21 rotatably supports an inside pusher roller 23. The latter 23 is extended along one of the generating lines of the cylindrical drum 1 in such a manner that it is in slide contact with the inner surface of the tubular wall 7.

The inside pusher roller 23 serves as an ink supplying squeegee roller. The inside pusher arm 21 fixedly supports a doctor rod 25 which is extended in parallel with the inside pusher roller 23 with a small gap between them. The inside pusher roller 23 and the doctor roller 25 form a wedge-shaped ink pool 27 into which printing ink is regularly supplied from an ink delivery pipe 29. The ink delivery pipe 29 is connected to an ink supplying hose 31. The hose 31 is extended through the central cylindrical shaft 13, thus being exposed outside the drum, and connected to an ink supplying source (not shown), to supply the printing ink to the ink pool 27.

As the inside pusher roller 23 is rotated counterclockwise in the figure, the ink in the ink pool 27 is supplied to the inner cylindrical surface of the flexible tubular wall 7 while being regulated by the doctor roller 25.

The inner frame 17 rotatably supports a cam shaft 33 to which a cam 35 is fixedly mounted. The cam 35 is a double-heart-shaped plate cam. The cam 35 is turned through 90° at a time, thus taking one of two stable positions, namely, a printing angular position shown in FIGS. 1 and 3, and the other stable position, namely, a non-printing angular position shown in FIGS. 2 and 4.

The cam 35 is engaged with a cam follower 39 mounted on a linkage yoke member 37. The latter 37 is linked to the other end portion of the inside pusher arm 21 through a shaft 41.

Figure 2:
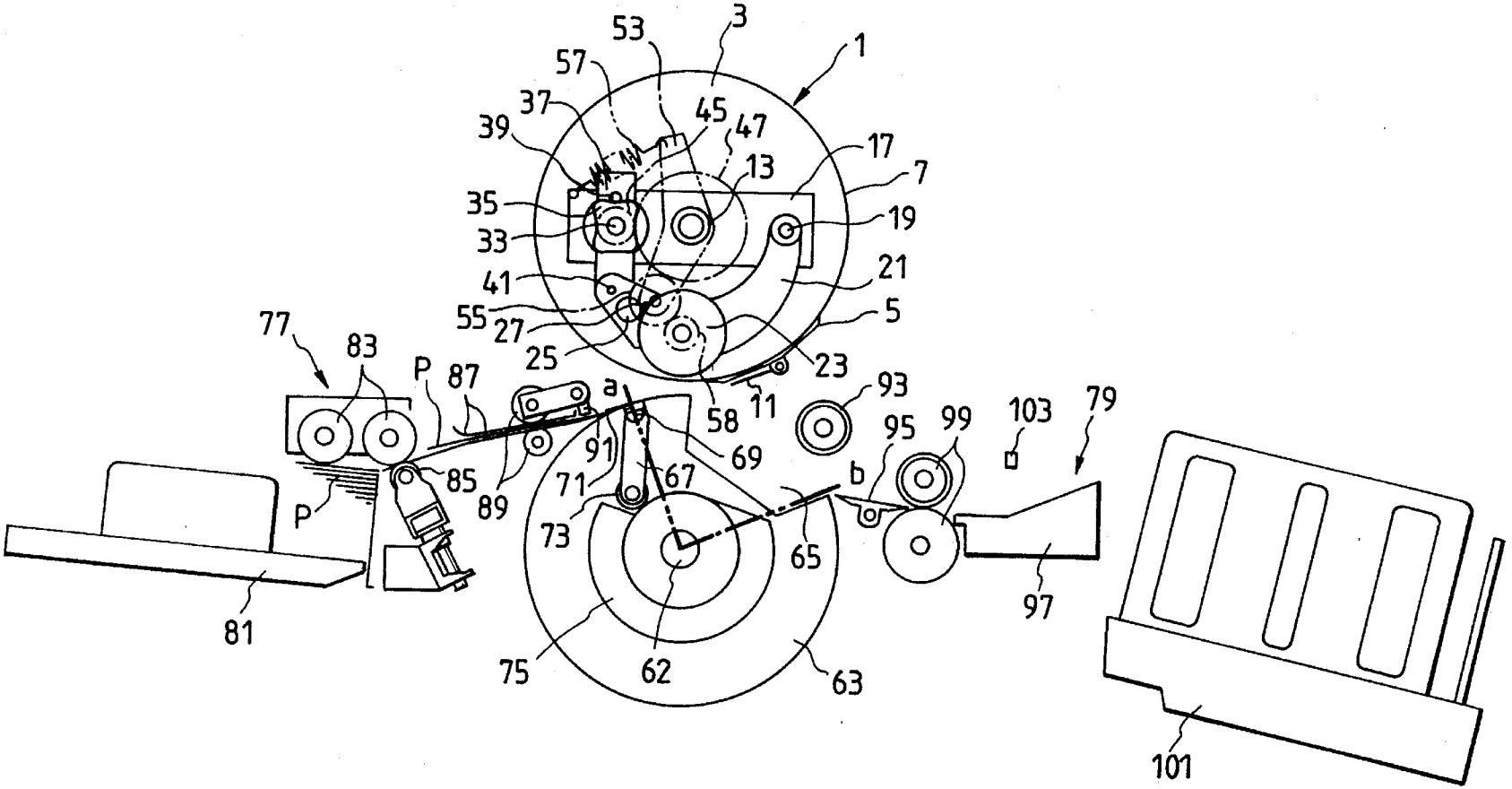
FIG. 2 is an explanatory diagram outlining the arrangement of the mimeographic printing machine according to the invention which is in a non-printing mode.
Figure 3:
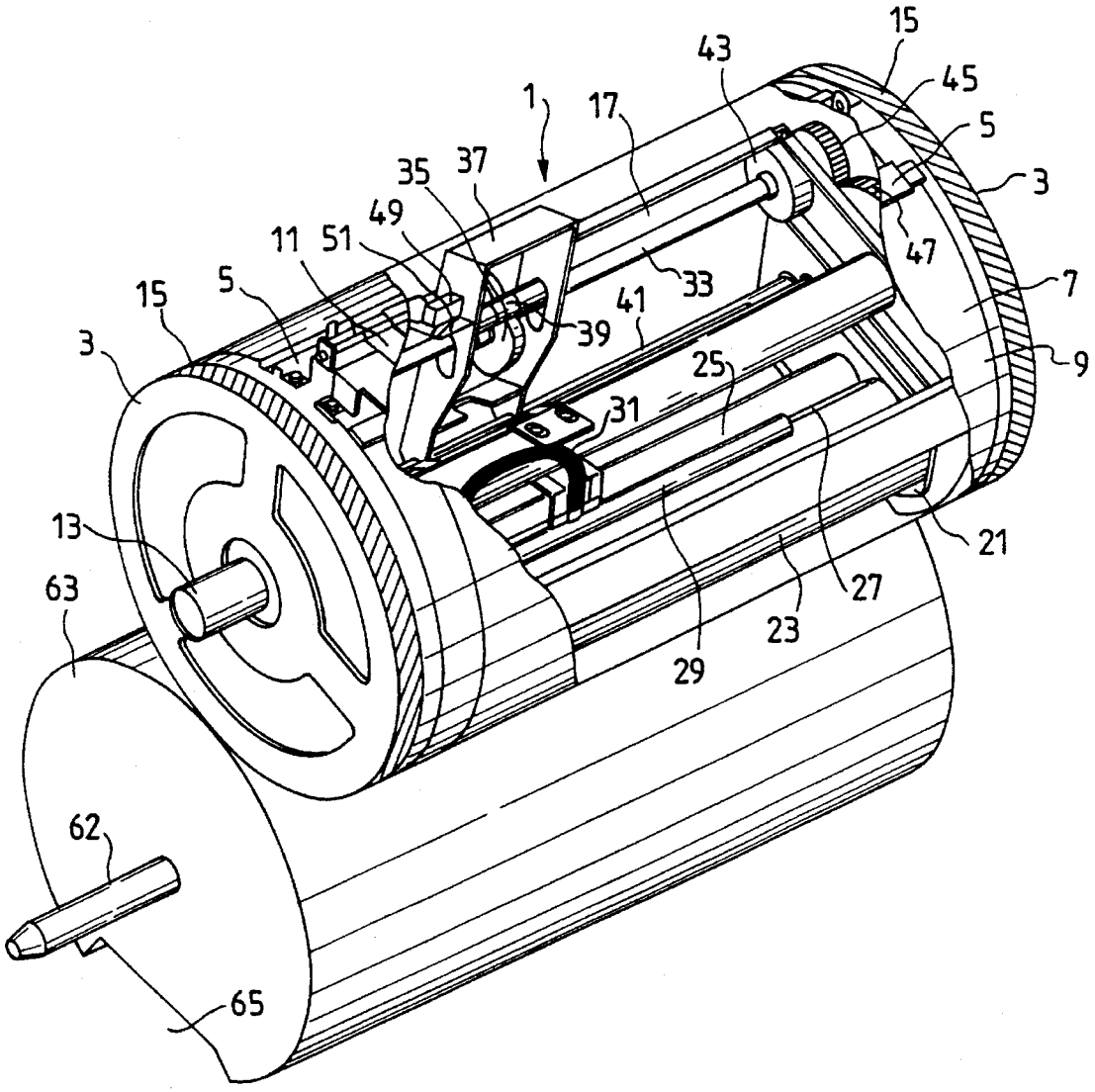
FIG. 3 is a perspective view showing essential components of the mimeographic printing machine of the invention which is in the printing mode.

Thus, when the cam 35 is at the printing angular position, the inside pusher roller 23 is at a lower position while being in slide contact with the inner surface of the tubular wall 7; whereas when it is at the non-printing angular position, as shown in FIG. 2 the inside pusher roller 23 is raised together with the inside pusher arm 21, thus being spaced from the inner surface of the tubular wall 7.

The cam shaft 33 is connected to the driven side of an electromagnetic clutch 43. The driving side of the latter 43 is coupled to a cam shaft drive gear 45, so that the cam shaft drive gear 45 and the cam shaft 33 are selectively coupled to each other by the electromagnetic clutch 43. The cam shaft drive gear 45 is engaged with an inside main gear 47 which is fixedly mounted on the side plate 3 of the drum 1, so that the gear 45 is turned by the rotation of the drum 1.

A cam switch 49 made up of a limit switch is mounted on the inside frame 17. The cam switch 49 is engaged with a switch actuating piece 51 mounted on the linkage yoke member 37, to detect the position of the cam 35; i.e., to determine whether the cam 35 is at the printing angular position or at the non-printing angular position.

The central cylindrical shaft 13 rotatably supports a roller drive arm 53 at the middle. One end portion of the roller drive arm 53 rotatably supports an intermediate gear 55. The other end portion of the roller drive arm 53 is connected to a tension spring 57 so that the arm 53 is urged counterclockwise in FIG. 1 by the elastic force of the tension spring 57. As a result, the intermediate gear 55 is engaged with the inside main gear 47 and with a gear 58 which is mounted on the end of the inside pusher roller 23 in such a manner that it is coaxial with the latter 23. Hence, as the drum 1 rotates, the intermediate gear 55 is turned to rotate the inside pusher roller 23 counterclockwise in FIG. 1.

When the inside pusher roller 23 is turned counterclockwise in FIG. 1 in the above-described manner under the condition that the cam 35 is at the printing angular position, and the inside pusher roller 23 is at the lower position while being in slide contact with the inner surface of the tubular wall 7, then the inside pusher roller 23 is set at a deformation position (cf. FIG. 1), thus being pushed against the inner surface of the tubular wall 7 to deform the latter 7 toward a lower pusher roller 63 (described latter).

On the other hand, when the inside pusher roller 23 is turned counterclockwise in FIG. 1 under the condition that the cam 35 is at the non-printing angular position, and the inside pusher roller 23 is spaced from the inner surface of the tubular wall 7, the inside pusher roller 23 will not deform the tubular wall 7. Hereinafter, this position of the inside pusher roller 23 (cf. FIG. 2) will be referred to as "a steady position", when applicable.

Figure 4:
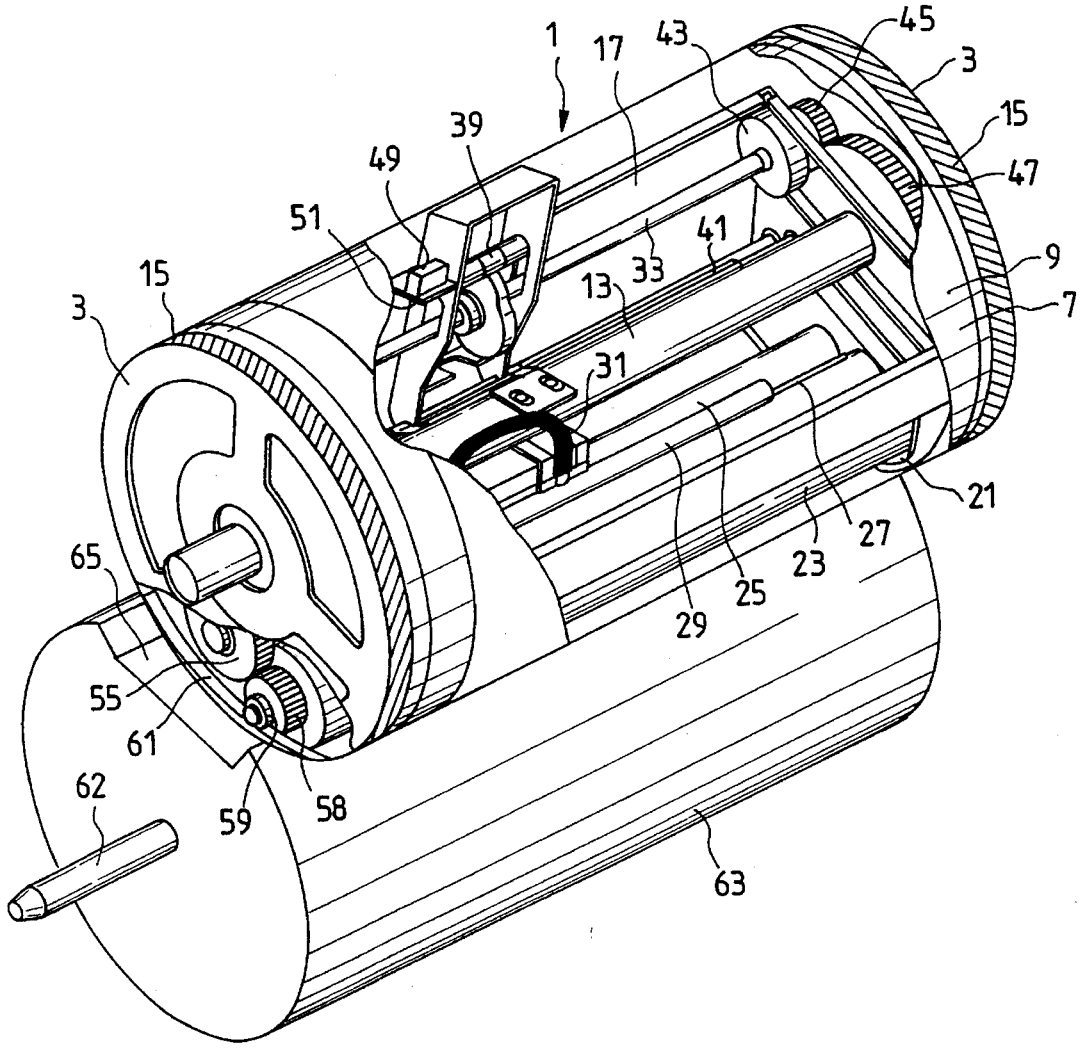
FIG. 4 is a perspective view showing essential components of the mimeographic printing machine according to the invention which is in the non-printing mode.

As shown in FIG. 4, a cam follower 59 is mounted on the inside pusher roller 23. The cam follower 59 is engaged with a cam 61 formed in the inner surface of the drum 1 as the latter 1 rotates. As a result, the inside pusher roller 23 is raised with a rotational phase of the drum 1 corresponding to the stencil paper clamping region of the latter 1; that is, the inside pusher roller 23 is prevented from pushing the inner surface of the tubular wall 7, which prevents the production of a collision sound by the collision of the clamp base plate 5 with the corners of a recess 65 of the lower pusher roller 63 (described later), and protects the screen member 9.

The lower pusher roller 63 is equal in outside diameter to the cylindrical printing drum 1. The lower pusher roller 63 is mounted on a central shaft 62 in such a manner that it is located at a predetermined distance from the tubular wall 7, and is in parallel with the drum 1. The lower pusher roller 63 is rotated clockwise (in FIG. 1) around its own central axis in synchronization with the drum 1 by a synchronous rotation drive unit (not shown) at the same speed as the drum 1. In order to prevent the interference of the lower pusher roller 63 with the stencil paper clamping section of the drum 1, the lower pusher roller 63 has the aforementioned recess 65 in the part of its outer surface which corresponds in angular position to the stencil paper clamping section of the drum 1.

When the tubular wall 7 is deformed depending on the positional relationship between the drum 1 and the lower pusher roller 63, then as shown in FIG. 1 the tubular wall 7 thus deformed pushes the stencil paper wound on the drum against the printing sheet P provided on the lower pusher roller 63. Upon releasing the tubular wall 7 from the deformation as shown in FIG. 2, a gap is formed between the drum 1 and the lower pusher roller 63.

The lower pusher roller 63 has a sheet clamping member 67 which is swingably mounted on the lower pusher roller 63 through a shaft 69. The sheet clamping member 67 is provided with a clamping piece 71 at one end which cooperates with the outer surface of the lower pusher roller 63 to detachably hold the printing sheet P. The sheet clamping member 67 is further provided with a cam follower roller 73 at the other end. When the cam follower roller 73 is engaged with a cam 75 which is fixedly set, the front leading end portion of the printing sheet P, which is supplied from a sheet supplying section 77 (provided on the left in FIG. 1) in synchronization with the rotation of the lower pusher roller 63, is clamped at an angular position (sheet clamping position) a (in FIG. 2) of the lower pusher roller 63, and is released at another angular position (sheet releasing position) b (in FIG. 2).

Thus, the lower pusher roller 63 acts as a roller having a printing sheet conveying function; that is, it causes the printing sheet P to be wound on its outer surface between the sheet clamping position a and the sheet releasing position b so that the printing sheet P is forcibly conveyed.

The sheet supplying section 77 includes: a sheet supplying table 81 on which printing sheets P are stacked; sheet supplying rollers 83 and a sheet separating roller 85 for taking the printing sheets P out of the sheet supplying table 81 one at a time; sheet guiding members 87; a pair of timing rollers 89 for delivering the printing sheet P to the sheet clamping position a (where the printing sheet P is clamped by the clamping piece 71) on the lower pusher roller 63 with predetermined timing; and a sheet supplying optical sensor 91 (hereinafter referred to merely as "a sheet supply sensor 91", when applicable) for detecting the delivery of the printing sheet P to the sheet nipping position a.

A sheet discharging section 79 includes: a sheet discharging pinch roller 93 which is provided at the sheet releasing position b and cooperates with the lower pusher roller 63 to pinch the printing sheet P to discharge the latter P; a sheet separating claw 95 for separating the printing sheet P from the lower pusher roller 63; a pair of pinch rollers 99 for sending the printing sheet P separated by the sheet separating claw to a sheet throwing stand 97; a sheet discharging tray 101 on which the printed sheets P are stacked; and a sheet discharging optical sensor 103 (hereinafter referred to merely as "a sheet discharge sensor 103", when applicable for detecting the throwing of the printing sheet P from the sheet throwing stand 97 to the sheet discharging tray 101.

The sheet discharging pinch roller 93 and the upper one of the pair of sheet discharging pinch rollers 99 are brought into contact with the upper side of the printing sheet P to be discharged which is a printing surface. More specifically, those rollers are so designed that they are brought into contact with both side margins of each printing sheet P where nothing is printed. In order to bring those rollers 93 and 99 into contact with only both side margins of each printing sheet P irrespective of the width of the latter P, the positions of those rollers 93 and 99 are automatically adjusted in the direction of axis according to the size of a printing sheet P. In this case, a sheet size sensor (not shown) which detects the size of the printing sheet P is provided on the sheet discharging tray 101.

Figure 5:
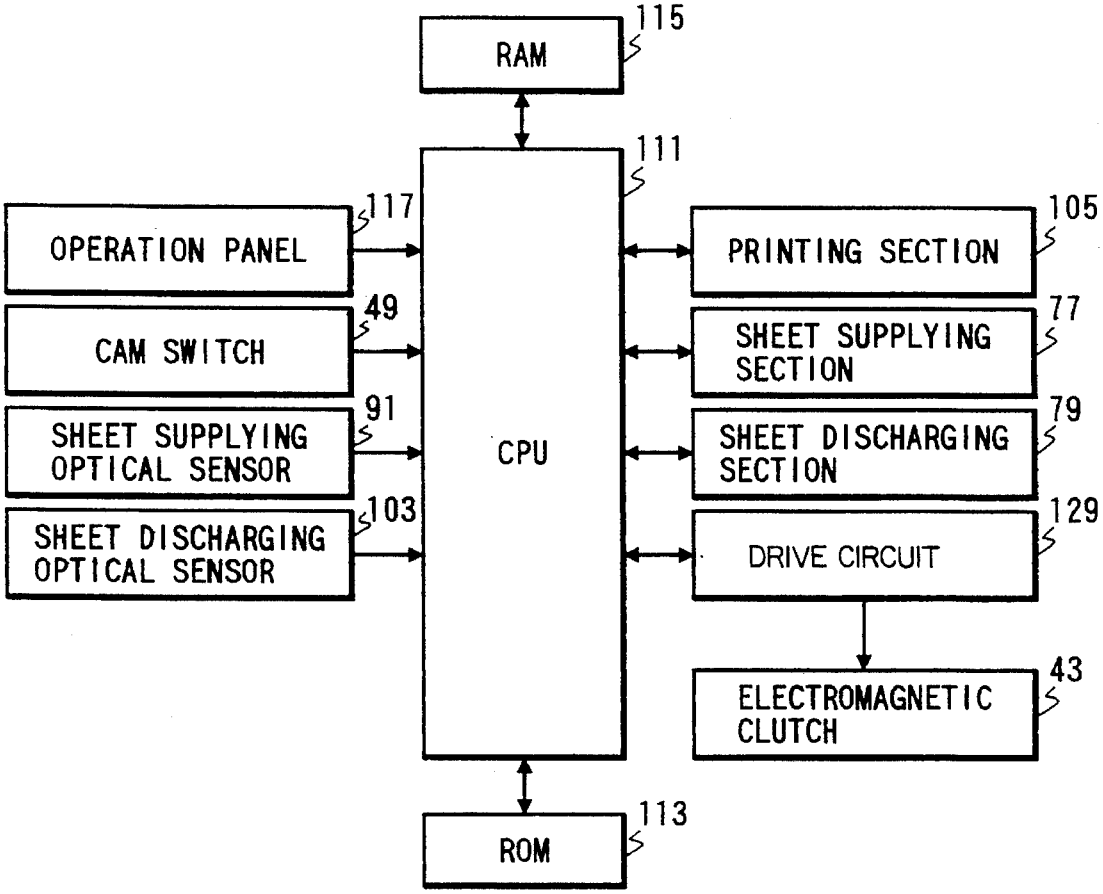
FIG. 5 is a block diagram showing a control system in the mimeographic printing machine of the invention.

FIG. 5 shows an example of a control system for the mimeographic printing machine. The control system comprises a CPU 111 made up of a microprocessor or the like; a ROM 113 in which a control program has been stored; and a RAM 115 for storing input data and others when necessary. The control system receives signals from the operating panel 117, the cam switch 49, the sheet supply sensor 91, the sheet discharge sensor 103, and other sensors and switches (not shown) to execute the control program, thereby to control the operation of a printing section 105 essentially including the flexible rotary cylindrical printing drum 1, the sheet supplying section 77, and the sheet discharging section 79.

Figure 6:
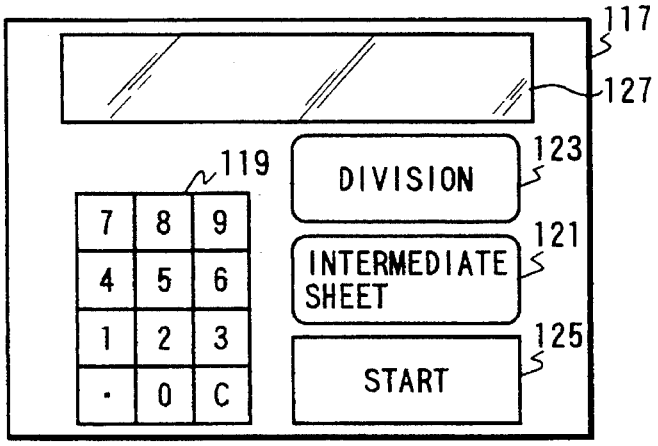
FIG. 6 is a plan view of an operating panel employed in the mimeographic printing machine of the invention.

The operating panel 117, as shown in FIG. 6, has: a ten-key board 119 for setting the number of copies of each print, the number of sets of prints, etc.; an intermediate sheet key 121 for setting an intermediate sheet supplying type printing mode; a division key 123 for setting a sheet dividing type printing mode; a start key 125 for instructing the start of a printing operation; and a display unit 127 made up of LCDs for displaying the number of copies of each print, the number of sets of prints, and other messages.

In response to the setting of the intermediate sheet supplying type printing mode or the sheet dividing type printing mode, the CPU 111 applies an operating instruction to a drive circuit 129 to control the electromagnetic clutch 43 for the sheet supplying operation of the sheet supplying section 77. As a result, the electromagnetic clutch 43 is operated intermittently, to turn the cam 35 90° at a time, so that the inside pusher roller 23 is set at the steady position.

Figure 7:
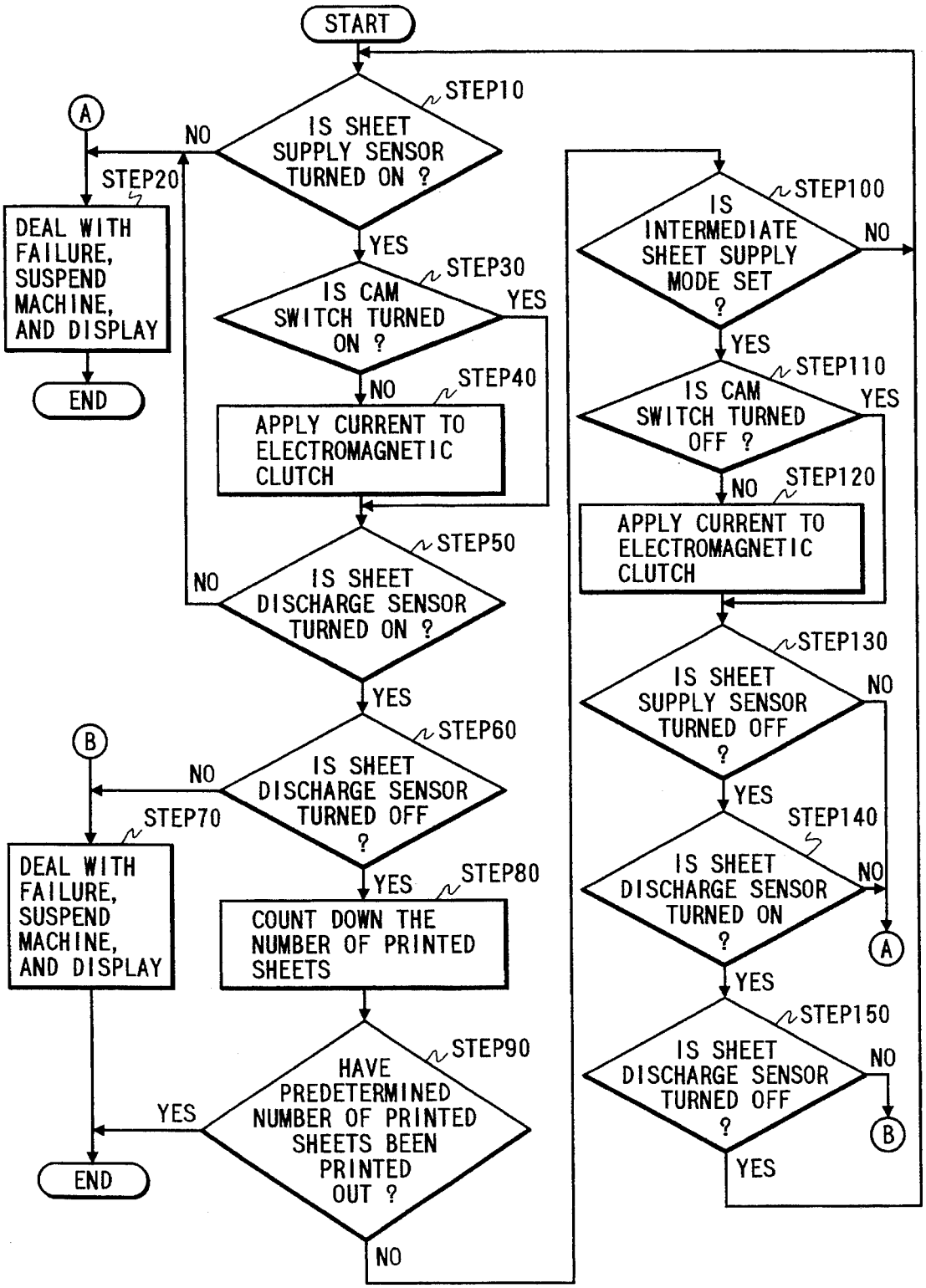
FIG. 7 is a flow chart for a description of the operation of the mimeographic printing machine according to the invention.

Now, the operation of the mimeographic printing machine thus organized will be described with reference to FIG. 7. After a stencil setting operation has been achieved; that is, after a stencil made by using the stencil paper is wound on the cylindrical printing drum 1, the ten-key board 119 on the operating panel 117 is operated to input the number of copies, and the start key 125 on the operating panel 117 is operated (depressed), so that the drum 1 and the lower pusher roller 63 start rotation. As a result, the printing sheets P are taken out of the sheet supply table 81 one at a time by the sheet supplying rollers 83 and the sheet separating roller 85, and the printing sheet P thus taken out is conveyed towards the pair of timing rollers 89 while being guided by the sheet guiding members 87.

When the drum 1 and the lower pusher roller 63 are turned to an angular position corresponding to a predetermined rotational phase, the pair of timing rollers 89 feed the printing sheet P to the sheet clamping position a on the lower pusher roller 63 with predetermined timing where the clamping piece 71 is provided. The feeding of the printing sheet P to the sheet clamping position a is monitored by the sheet supply sensor 91 (Step 10). If the sensor 91 is not turned on, then the operation of the machine is suspended, and the failure that no sheet has been fed to the sheet clamping position a is displayed on the display unit; that is, a process for dealing with the failure in supplying a printing sheet is carried out (Step 20).

Next, it is determined whether or not the cam switch 49 is turned on; that is, it is detected whether or not the cam 35 is at the printing angular position (Step 30). When it is determined that the switch 49 is not turned on, then current is applied to the electromagnetic clutch 43 for a predetermined period of time (Step 40).

As a result, the cam 35 is turned through 90° to come to the printing angular position, while the inside pusher roller 23 is moved to the aforementioned lower position as shown in FIG. 1, so that, as the drum 1 rotates, it pushes the flexible tubular wall 7 radially outwardly; that is, the latter 7 is deformed towards the lower pusher roller 63.

Under this condition, the clamping piece 71 of the lower pusher roller 63 clamps the front leading end portion of the printing sheet P at the sheet clamping position a. Therefore, as the lower pusher roller 63 turns, the printing sheet P, while being wound on the outer surface of the latter 63, is moved to the nipping region between the drum 1 and the lower pusher roller 63; that is, it is moved to the deformed portion of the tubular wall 7. Hence, the printing paper P is held between the drum 1 and the lower pusher roller 63 in such a manner that the printing paper P is subjected to the predetermined pressure from the deformed portion of the tubular wall 7. Therefore, as the drum 1 and the lower pusher roller 63 turn, the printing sheet P is subjected to mimeographic printing while being moved to the right in FIG. 1.

When the drum 1 and the lower pusher roller 63 turn until the clamping piece 71 comes to the sheet releasing position b, the printing sheet P is released from the clamping piece 71, and the conveyance of the printing sheet P is now carried out by the sheet discharging pinch roller 93. Thereafter, the printing sheet P is separated from the lower pusher roller 63 by the sheet separating claw 95, and then moved to the sheet throwing stand 97. The printing sheet P is thrown from the stand 97 over to the sheet discharging tray 101, where it is placed with the printed side at the top.

During the above-described sheet discharging operation, a sheet discharge sensor 103 determines whether or not the printing sheet has reached the sheet throwing stand 97 within a predetermined period of time from the time instant that the sheet supply sensor is turned on (Step 50). When the sheet discharge sensor 103 is not turned on within the predetermined period of time, the above-described Step 20 is effected again; that is, the process for dealing with the failure in supplying a printing sheet is carried out.

Where, on the other hand, the sheet discharge sensor 103 is turned on within the predetermined period of time, the completion of the sheet discharging operation is monitored; that is, it is monitored whether or not the sheet discharge sensor 103 is turned off thereafter (Step 60).

In the case where the sheet discharge sensor 103 is not turned off within a predetermined period of time from the time instant that the sheet discharge sensor 103 is turned on, then the operation of the machine is suspended, and the failure in discharging the printing sheet is displayed on the display unit 127; that is, a process for dealing with the failure in discharging a printing sheet is carried out (Step 70).

When, on the other hand, the sheet discharge sensor 103 is turned off within the predetermined period of time from the time instant that the sheet discharge sensor is turned on; that is, when the throwing of the printing sheet P from the sheet throwing stand 97 to the sheet discharging tray 101 is confirmed, then the count value set for the number of printed sheets is decreased by one (count down) (Step 80), to determine whether or not the predetermined number of copies have been printed out (Step 90).

In the case where the predetermined number of copies have not been printed out, then it is determined whether or not the intermediate sheet key 121 on the operating panel 117 has been turned on; that is, whether or not the intermediate sheet supplying type printing mode has been set (Step 100). In the case where the intermediate sheet supplying type printing mode has not been set, then the above-described Step 10 is effected again for the following mimeographic printing operation.

In the case where, on the other hand, the intermediate sheet supplying type printing mode has been set, then in order to supply the intermediate sheets it is determined whether or not the cam switch 49 is off; that is, whether or not the cam 35 is at the non-printing angular position (Step 110). When it is determined that the cam switch 49 is not off, current is supplied to the electromagnetic clutch 43 for a predetermined period of time (Step 120).

As a result, the cam 35 is turned through 90° to come to the non-printing angular position, and the inside pusher roller 23 is moved to the steady position, thus eliminating the deformation of the flexible tubular wall 7 of the drum 1. As a result, a gap is formed between the drum 1 and the lower pusher roller 63 to allow the passage of the printing sheet P.

Under this condition, the printing sheets P are taken out of the sheet supplying table 81 one at a time with the aid of the sheet supplying rollers 83 and the sheet separating roller 85. The printing sheet P thus taken out is forwarded to the pair of timing rollers 89 while being guided by the sheet guiding members 87. On the other hand, the drum 1 and the lower pusher roller 63 are kept turned. When the drum 1 and the roller 63 are turned to an angular position corresponding to a predetermined rotational phase, similarly as in the case of the above-described printing operation the pair of timing rollers 89 feed the printing sheet P to the sheet clamping position a on the lower pusher roller 63 with predetermined timing where the clamping piece 71 is provided. The feeding of the printing sheet P to the sheet clamping position a is monitored by the sheet supply sensor 91 (Step 130). If the sensor 91 is not turned on, then the operation of the machine is suspended, and the failure in feeding a printing sheet is displayed on the display unit 127; that is, the above-described process for dealing with the failure in supplying a printing sheet is carried out (Step 20).

When the printing sheet P has reached the sheet clamping position a, similarly as in the case of the printing operation the clamping piece 71 of the lower pusher roller 63 holds the front leading end portion of the printing sheet P at the sheet clamping position a. As a result, the printing sheet P is wound on the lower pusher roller 63. Hence, while not being brought into contact with the drum 1; more specifically, while not being brought into contact with the stencil paper set on the drum, the printing sheet P is moved to the right in FIG. 1 as it is (not being printed).

When the drum 1 and the lower pusher roller 63 turn until the clamping piece 71 comes to the sheet releasing position b, the printing sheet P is released from the clamping piece 71, and the conveyance of the printing sheet P on which nothing is printed is carried out by the sheet discharging pinch roller 93. Thereafter, the printing sheet P is separated from the lower pusher roller 63 by the sheet separating claw 95, and then delivered onto the sheet throwing stand 97 by the pair of sheet discharging pinch rollers 99. The printing sheet P thus delivered is thrown over to the sheet discharging tray 101, where it is laid as an intermediate sheet.

In this sheet discharging operation too, the sheet discharge sensor 103 monitors whether or not the printing sheet P is delivered onto the sheet throwing stand 97 within the predetermined period of time from the time instant that the sheet supply sensor is turned on (Step 140). If it is determined that the sheet discharge sensor 103 is not turned on within the predetermined period of time, the above-described process of dealing with the failure in supplying a printing sheet is carried out (Step 20).

In the case where, on the other hand, the sheet discharge sensor 103 is turned on within the predetermined period of time, the completion of the sheet discharging operation is monitored; that is, it is monitored whether or not the sheet discharge sensor 103 is turned off thereafter (Step 150). In the case where the sheet discharge sensor 103 is not turned off within a predetermined period of time from the time instant that the sheet discharge sensor 103 is turned on, then the operation of the machine is suspended, and the failure in discharging the printing sheet is displayed on the display unit 127; that is, the above-described process for dealing with the failure in discharging a printing sheet is carried out (Step 70).

When, on the other hand, the sheet discharge sensor 103 is turned off within the predetermined period of time from the time instant that the sheet discharge sensor is turned on; that is, when the throwing of the printing sheet P from the sheet throwing stand 97 to the sheet discharging tray 101 is confirmed, then Step 10 is effected again for the following mimeographic printing operation.

Figure 8:
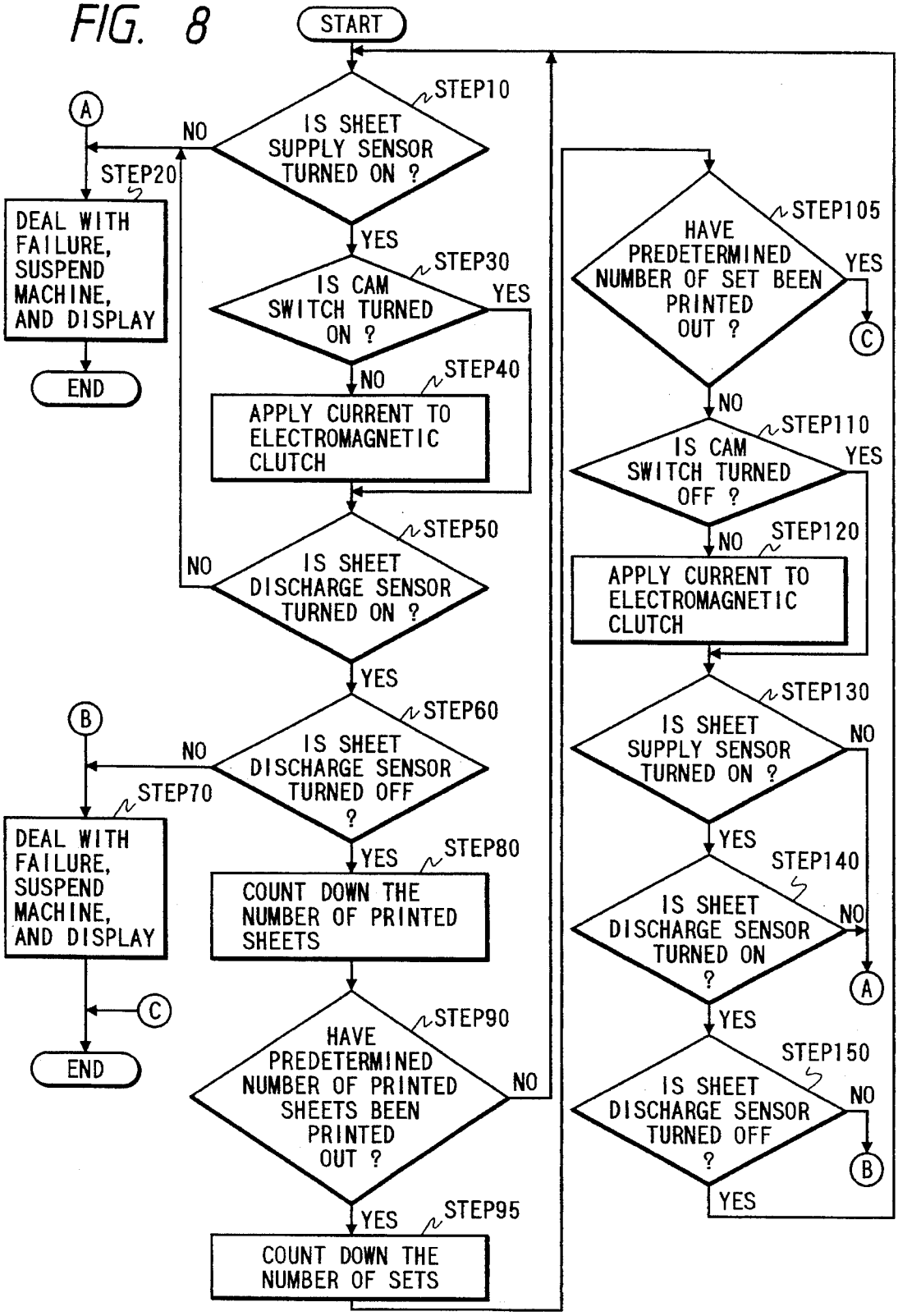
FIG. 8 is also a flow chart for a description of the operation of the mimeographic printing machine according to the invention which is in the printing mode.

FIG. 8 is a flow chart for a description of the operation of the mimeographic printing machine in the case where the sheet dividing type printing mode is set by operating the division key 123 on the operating panel 117. In the sheet dividing type printing mode, the number of copies (printed sheets) per set and the number of sets of copies are inputted. In FIG. 8, Steps 10 through 90, and 110 through 150 are equal to those in FIG. 7. In the sheet dividing type printing mode, whenever one set of copies has been obtained (Step 90), the count value set for the number of sets of copies is decreased by one (count down) (Step 95); and Steps 110 through 150 are effected until the number of sets of copies reaches a predetermined value (the inputted number of sets of copies) (Step 105). Similarly as in the case of supplying the intermediate sheet, the printing sheet P is passed through the gap between the drum 1 and the lower pusher roller 63 without touching the drum 1 (not being printed) and placed, as a dividing sheet, on the sheet discharging tray 101.

Figure 9:
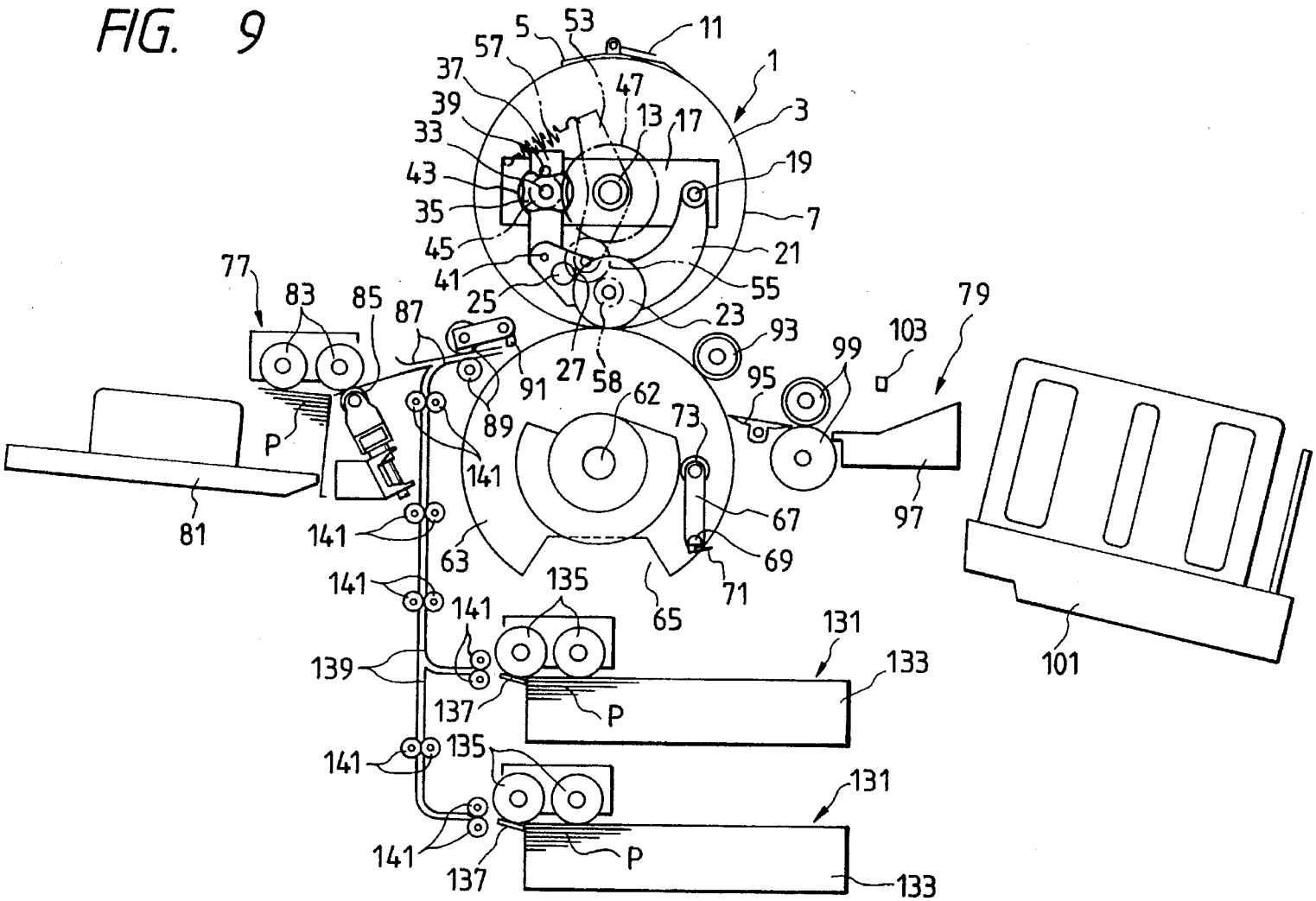
FIG. 9 is an explanatory diagram showing the arrangement of another mimeographic printing machine according to the invention.

FIG. 9 shows another example of the mimeographic printing machine according to the invention, which constitutes a second embodiment of the invention. In FIG. 9, parts corresponding functionally to those which have been described with reference to FIG. 1 are therefore designated by the same reference numerals or characters.

In the embodiment, in addition to the sheet supplying section 77 including the sheet supplying table 81, a pair of cassette sheet supplying sections 131 and 131 are provided in two steps. The cassette sheet supplying sections 131 comprise sheet cassettes 133 which accommodate printing sheets P which are different in size from each other and from those P on the sheet supplying table 81. Each of the cassette sheet supplying sections 131 further includes a pair of sheet supplying rollers 135 and a sheet separating pad 137 which operate to take the printing sheets P out of the sheet cassette 133 one by one.

The printing sheet P taken out of the sheet cassette 133 is forwarded to the pair of timing rollers 89 by pairs of auxiliary sheet feeding rollers 141 while being guided by sheet guiding members 139.

In the embodiment, sheet selection control is carried out, so that printing sheets P different in size can be selectively used without manual sheet exchanging work. In supplying the intermediate sheet or dividing sheet, the sheet selection control is automatically switched, so that a printing sheet P different from the printed sheet is supplied as the intermediate sheet or dividing sheet.

In this case, since the printing sheet P as the intermediate sheet or dividing sheet is different in size from the printed sheet, the removal of the intermediate sheets from the stack of printed sheets can be achieved with ease, and in the case of the sheet dividing type printing mode the division of the printed sheets into groups can be positively performed.

As is apparent from the above description, in the mimeographic printing machine with the flexible rotary cylindrical printing drum, the inside pusher roller is selectively positioned at the steady position by the operation of the inside pusher roller position controlling device in association with the sheet supplying operation of the sheet supplying section to release the flexible tubular wall from deformation. Under the condition that the inside pusher roller is held at the steady position, the printing sheet from the sheet supplying section is passed through the space between the cylindrical printing drum and the lower pusher roller without touching the cylindrical printing drum. The printing sheet thus passed is used as an intermediate sheet or dividing sheet as it is (not being printed). That is, the supplying of the intermediate sheets or dividing sheets can be achieved economically without use of a specialized device.

What is claimed is:

1. A mimeographic printing machine comprising:

a flexible rotary cylindrical printing drum including a flexible tubular wall enabling ink to pass therethrough, on an outer surface of which a stencil paper is wound;

a lower pusher roller in parallel with said flexible rotary cylindrical printing drum with a predetermined space between said lower pusher roller and said flexible rotary cylindrical printing drum;

an inside pusher roller provided inside said flexible rotary cylindrical printing drum in such a manner that said inside pusher roller is extended in parallel with a generating line of said flexible rotary cylindrical printing drum, said inside pusher roller being movable between a deformation position to push said flexible tubular wall radially outwardly thereby to deform said flexible tubular wall towards said lower pusher roller, and a steady position to release said flexible tubular wall from the deformation;

a sheet supplying section for supplying a printing sheet to said lower pusher roller;

inside pusher roller controlling means for positioning said inside pusher roller at said steady position in case of non-printing and said deformation position in case of printing in association with a sheet supplying operation of said sheet supplying section; and printing sheet conveying means, including said lower pusher roller, for conveying the printing sheet through the space between said flexible rotary cylindrical printing drum and said lower pusher roller when said inside pusher roller is in said steady position in conjunction with rotation of said lower pusher roller.

2. A mimeographic printing machine according to claim 1, wherein a width of said predetermined space is such that the printing sheet is pressed by said outer surface of said flexible rotary cylindrical printing drum during the printing sheet moving into the space when said inside pusher roller is held at said deformation position, and that the printing sheet passes through the space without contacting said flexible rotary cylindrical printing drum when said inside pusher roller is held at said steady position.

3. A mimeographic printing machine according to claim 1, wherein said conveying means includes a printing sheet clamping mechanism which is adapted to clamp a front leading end portion of said printing sheet supplied from said sheet supplying section in such a manner that said front leading end portion can be released, and which conveys said printing sheet through the space between said flexible rotary cylindrical printing drum and said lower pusher roller in association with the rotation of said lower pusher roller.

4. A mimeographic printing machine according to claim 1, wherein said sheet supplying section includes at least two sheet cassettes, one of said sheet cassettes storing sheets which has a different size from sheets stored in the other one of said sheet cassettes.

5. A mimeographic printing machine according to claim 1, wherein said inside pusher roller controlling means includes an inside pusher arm which supports said inside pusher roller, a linkage yoke member which is rotary engaged with said inside pusher arm, a cam follower which is mounted on said linkage yoke member, a cam which engages said cam follower, and a driver which drives to rotate said cam 90° at one time.

6. A mimeographic printing machine including:

a flexible rotary cylindrical printing drum including a flexible tubular wall enabling to pass an ink, on an outer surface of which a stencil paper is wound;

a lower pusher roller in parallel with said flexible rotary cylindrical printing drum with a predetermined space between said lower pusher roller and said flexible rotary cylindrical printing drum;

an inside pusher roller provided inside said flexible rotary cylindrical printing drum in such a manner that said inside pusher roller is extended in parallel with a generating line of said flexible rotary cylindrical printing drum, said inside pusher roller being movable between a deformation position to push said flexible tubular wall radially outwardly thereby to deform said flexible tubular wall towards said lower pusher roller, and a steady position to release said flexible tubular wall from the deformation;

a sheet supply section for supplying a printing sheet; and a sheet discharge section, in which, with said inside pusher roller at said deformation position, the printing sheet is supplied from said sheet supplying section to the space between said flexible rotary cylindrical printing drum and said lower pusher roller to perform a pressure type mimeographic printing operation, and said printing sheet, after printed, is discharged to said sheet discharging section, wherein the improvement comprises:

inside pusher roller controlling means for selectively positioning said inside pusher roller at said steady position in association with a sheet supplying operation of said sheet supplying section; and printing sheet conveying means which, under the condition that said inside pusher roller is held at said steady position by the operation of said inside pusher roller controlling means, causes said printing sheet from said sheet supplying section to pass through the space between said flexible rotary cylindrical printing drum and said lower pusher roller, in such a manner that said printing sheet is not brought into contact with said flexible rotary cylindrical printing drum, so that said printing sheet is discharged into said sheet discharging section without being printed, said conveying means including said pusher roller.

7. A mimeographic printing machine according to claim 6, wherein a width of said predetermined space is such that the printing sheet is pressed by said outer surface of said flexible rotary cylindrical printing drum during the printing sheet moving into the space when said inside pusher roller is held at said deformation position, and that the printing sheet passes through the space without contacting said flexible rotary cylindrical printing drum when said inside pusher roller is held at said steady position.

* * * * *